US008714096B2

(12) United States Patent
Orii et al.

(10) Patent No.: US 8,714,096 B2
(45) Date of Patent: May 6, 2014

(54) PULVERIZED COAL BOILER

(75) Inventors: Akihito Orii, Hitachi (JP); Hirofumi Okazaki, Mito (JP); Yusuke Ochi, Kure (JP)

(73) Assignee: Babcock-Hitachi K.K., Tokyo (JP)

( * ) Notice: Subject to any disclaimer, the term of this patent is extended or adjusted under 35 U.S.C. 154(b) by 134 days.

(21) Appl. No.: 13/390,597

(22) PCT Filed: Aug. 3, 2010

(86) PCT No.: PCT/JP2010/004878

§ 371 (c)(1), (2), (4) Date: Feb. 15, 2012

(87) PCT Pub. No.: WO2011/030501

PCT Pub. Date: Mar. 17, 2011

(65) Prior Publication Data

US 2012/0137938 A1 Jun. 7, 2012

(30) Foreign Application Priority Data

Sep. 11, 2009 (JP) ..... 2009-209877

(51) Int. Cl.
*F23L 9/02* (2006.01)
*F23C 7/02* (2006.01)

(52) U.S. Cl.
USPC ..... 110/310; 110/261; 110/265

(58) Field of Classification Search
CPC ..... F23C 2201/101; F23C 7/00; F23C 7/002; F23C 7/004; F23C 7/006; F23C 7/02; F23L 9/02; F23L 9/04; F23D 1/00; F23D 1/005; F23D 1/02; F23D 1/06; F23D 2200/00; F23D 2201/00; F23D 2201/10; F23D 2201/101; F23D 2201/20
USPC ..... 110/297, 348, 210, 214, 104 B, 260, 110/261, 262, 263, 264, 265
See application file for complete search history.

(56) References Cited

U.S. PATENT DOCUMENTS 6,024,030 A * 2/2000 Okamoto et al. ..... 110/261
6,089,170 A * 7/2000 Conti et al. ..... 110/262
(Continued)

FOREIGN PATENT DOCUMENTS

JP 59-124837 8/1984
JP 60-174408 9/1985
(Continued)

*Primary Examiner* — Kenneth Rinehart
*Assistant Examiner* — David J Laux
(74) *Attorney, Agent, or Firm* — Antonelli, Terry, Stout & Kraus, LLP.

(57) ABSTRACT

A pulverized coal boiler of the present invention is structured so as to form, among upper and lower after-air nozzles, an opening serving as an outlet of the lower after-air nozzle positioned on the upstream side is formed in a rectangular shape, a cylindrical section for defining a minimum flow path area of combustion air flowing through a flow path of the after-air nozzle is installed inside of the lower after-air nozzles along the flow path of the lower after-air nozzle, and a swirl blade for giving a swirl force to the combustion air flowing through the flow path of the after-air nozzles is installed inside of the cylindrical section, and the flow path of the lower after-air nozzles is formed so that a flow path area of the flow path of the after-air nozzles through which the combustion air flows from a position where the cylindrical section is installed toward the opening of each of the lower after-air nozzles is expanded.

12 Claims, 7 Drawing Sheets

(56) References Cited

U.S. PATENT DOCUMENTS

| | | | | |
|---|---|---|---|---|
| 8,430,665 | B2 * | 4/2013 | Payne et al. | 110/210 |
| 2002/0144636 | A1 | 10/2002 | Tsumura et al. | |
| 2003/0145768 | A1 | 8/2003 | Vatsky | |
| 2006/0090677 | A1 | 5/2006 | Taniguchi et al. | |
| 2006/0115779 | A1 | 6/2006 | Yamamoto et al. | |

FOREIGN PATENT DOCUMENTS

| | | | |
|---|---|---|---|
| JP | 64-70609 | | 3/1989 |
| JP | 4-52414 | | 2/1992 |
| JP | 5-18510 | | 1/1993 |
| JP | 9-310807 | | 12/1997 |
| JP | 2000-97430 | | 4/2000 |
| JP | 2001-221406 | | 8/2001 |
| JP | 2005-517149 | | 6/2005 |
| JP | 2006-132798 | | 5/2006 |
| JP | 2007-107850 | | 4/2007 |
| JP | 2007-232328 | | 9/2007 |
| JP | 2009-103346 | | 5/2009 |
| WO | WO 02/12791 | A1 | 2/2002 |
| WO | WO 03/067167 | A2 | 8/2003 |

* cited by examiner

CROSS SECTION A–A

PULVERIZED COAL BOILER

TECHNICAL FIELD

The present invention relates to a pulverized coal boiler and more particularly to a pulverized coal boiler including an after-air nozzle on the downstream side of a burner installed in a furnace of the pulverized coal boiler.

BACKGROUND ART

In the pulverized coal boiler, it is requested to suppress the NOx concentration contained in combustion gas generated when the pulverized coal fuel is burned by the pulverized coal boiler and as a measure against it, a double combustion method is mainly used.

A pulverized coal boiler with the double combustion method applied to, for example, as disclosed in Japanese Patent Laid-open No. Hei 9 (1997)-310807, is structured so as to install a pulverized coal burner in the furnace of the pulverized coal boiler and an after-air nozzle on the downstream side of the burner, feed pulverized coal fuel and combustion air from the burner, feed only combustion air from the after-air nozzle, thereby burning the pulverized coal fuel.

And, firstly, in the combustion by the burner section of the pulverized coal boiler, air of a volume lower than the theoretical air ratio necessary for perfect combustion of the pulverized coal fuel is fed into the furnace from the burner to burn the pulverized coal in a state of insufficient air, and NOx generated by the combustion of pulverized coal by the burner in a reductive atmosphere is reduced to nitrogen, thus the generation of NOx in the combustion gas is suppressed.

However, in the reductive atmosphere, unburned components remain due to insufficient oxygen and CO (carbon monoxide) is generated. Therefore, next, to perfectly burn the unburned components and CO which are generated in the reductive atmosphere, from the after-air nozzle positioned on the downstream side of the burner, combustion air slightly more than the air volume which is a deficiency of the theoretical air ratio is fed to the furnace to burn the unburned components and CO, and combustion exhaust gas with the unburned components and CO reduced is discharged from the pulverized coal boiler.

In the double combustion method of the pulverized coal boiler disclosed in Japanese Patent Laid-open No. Hei 9 (1997)-310807, to greatly reduce the unburned components, it is required to promote the mixture of combustible gas of imperfect combustion rising from the burner and after-air fed from the after-air nozzle.

Therefore, in Japanese Patent Laid-open No. Hei 4 (1992)-52414, to promote mixture of combustible gas of imperfect combustion rising from the burner installed in the boiler and after-air fed from the after-air nozzle, an after-air nozzle having a structure that the flowing form of the injection flow fed from the after-air nozzle is adjusted so as to have both a straight flow and a swirl flow is disclosed.

PRIOR TECHNICAL DOCUMENT

Patent Document

{Patent Document 1}
Japanese Patent Laid-open No. Hei 9 (1997)-310807
{Patent Document 2}
Japanese Patent Laid-open No. Hei 4 (1992)-52414

DISCLOSURE OF THE INVENTION

Problems to be solved by the Invention

The after-air nozzle of the boiler disclosed in Japanese Patent Laid-open No. Hei 4 (1992)-52414 is not questionable because the shape of the opening of the outlet of the after-air nozzle is circular. However, when the opening of the outlet of the after-air nozzle is formed in a rectangular shape, it is expected that in the flow of the injection flow injected from the outlet of the after-air nozzle to form a deflection flow caused by the rectangular opening, and it is difficult to form a swirl flow along the inner wall of the furnace of the boiler.

An object of the present invention is to provide a pulverized coal boiler, when the opening of the outlet of the after-air nozzle is formed in a rectangular shape, for permitting an injection flow of combustion air injecting from the after-air nozzle into the furnace to be fed to the vicinity of the inner wall of the furnace and making it possible to reduce unburned components and CO which exist in the vicinity of the inner wall of the furnace.

Means for Solving the Problems

The pulverized coal boiler of the present invention is a pulverized coal boiler comprising burners installed on a furnace wall for feeding pulverized coal into the furnace together with combustion air and burning the pulverized coal at lower than a theoretical air ratio and after-air nozzles installed respectively on the furnace wall on a downstream side of the burners for feeding combustion air of a deficiency of the burners into the furnace which are arranged at two stages on the downstream side and an upstream side, wherein among the lower and upper after-air nozzles interconnected to an inside of the furnace, an opening serving as an outlet of each of the lower after-air nozzles positioned on the upstream side is formed in a rectangular shape, a cylindrical section for defining a minimum flow path area of combustion air flowing through a flow path of the after-air nozzle is installed inside of the lower after-air nozzles along the flow path of the lower after-air nozzle, and a swirl blade for giving a swirl force to the combustion air flowing through the flow path of the after-air nozzles is installed inside of the cylindrical section, and the flow path of the lower after-air nozzles is formed so that a flow path area of the flow path of the after-air nozzles through which the combustion air flows from a position where the cylindrical section is installed toward the opening of each of the lower after-air nozzles is expanded.

Effects of the Invention

According to the present invention, a pulverized coal boiler can be realized, when the opening of the outlet of each after-air nozzle is formed in a rectangular shape, a pulverized coal boiler for permitting an injection flow of combustion air injecting from the after-air nozzle into the furnace to be fed to the vicinity of the inner wall of the furnace and making it possible to reduce unburned components and CO which exist in the vicinity of the inner wall of the furnace.

DETAILED DESCRIPTION OF THE INVENTION

The after-air nozzles of the pulverized coal boiler that is an embodiment of the present invention will be explained below with reference to the accompanying drawings.

Embodiment 1

Figure 1:
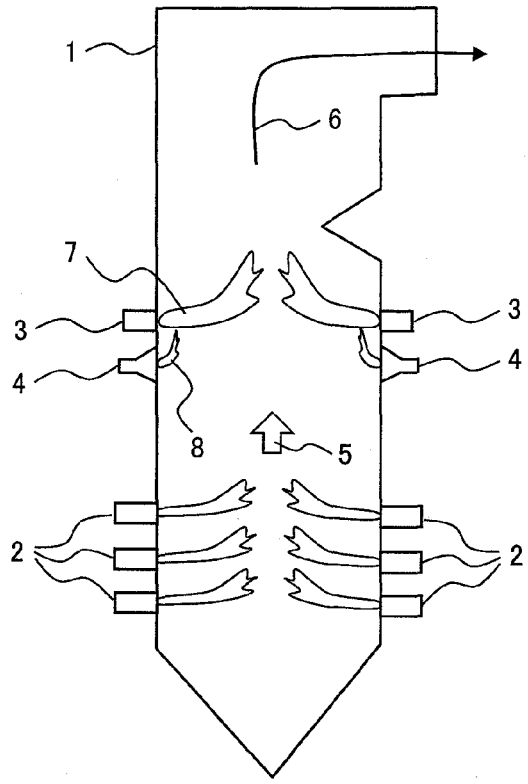
FIG. 1 is a cross sectional view of the boiler in the longitudinal direction showing a schematic structure of the pulverized coal boiler which is a subject of the present invention.

FIG. 1 shows a schematic structure of the pulverized coal boiler including the after-air nozzles that is an embodiment of the present invention. In FIG. 1, on the lower wall surface of a furnace 1 composing the pulverized coal boiler, a plurality of burners 2 for feeding and burning both pulverized coal fuel and combustion air inside the furnace 1 are installed away from each other in the horizontal direction, and combustion air of a volume lower than the theoretical air ratio necessary for perfect combustion of pulverized coal fuel is fed into the furnace 1 from the burners 2, and the pulverized coal is burned in a state of insufficient air, and NOx generated due to combustion of the pulverized coal by the burners in the reductive atmosphere is reduced to nitrogen, and the generation of NOx contained in combustion gas 5 of the burner section is suppressed.

On the upper wall surface of the furnace 1 positioned on the downstream side of the combustion gas from the burners 2, a plurality of after-air nozzles 3 and 4 for feeding combustion air into the furnace 1 are installed at the upper and lower stages away from each other in the horizontal direction.

Among the upper and lower after-air nozzles, the after-air nozzles 3 are installed on the wall surface of the furnace 1 on the downstream side of the combustion gas above the wall surface of the furnace 1 where the after-air nozzles 4 are installed and a structure that the upper after-air nozzles 3 and the lower after-air nozzles 4 compose the after-air nozzles arranged at the upper and lower stages is adopted.

And, from the after-air nozzles 3 positioned at the upper stage (on the downstream side), an injection flow 7 of combustion air 30 is fed into the furnace 1, thus in a reductive atmosphere formed in the furnace 1 by the burners 2, to burn perfectly unburned components remaining due to insufficient oxygen and generated CO (carbon monoxide), the combustion air 30 slightly more than the air volume which is a deficiency of the theoretical air ratio is fed into the furnace 1 to burn the unburned components and CO.

Furthermore, from the after-air nozzles 4 positioned at the lower stage (on the upstream side) of the upper after-air nozzles 3, an injection flow 8 of the combustion air 30 is fed along the inner wall of the furnace 1, thus compared with the combustion air fed from the upper after-air nozzles 3, the injection flow 8 (combustion air) of a low flow quantity and a low flow rate is fed into the furnace 1 of the boiler.

As mentioned above, from the lower after-air nozzles 4, the injection flow 8 of a low flow quantity and a low flow rate is fed in the vicinity of the inner wall of the furnace 1, thus to the unburned components and CO easily staying in the vicinity of the inner wall of the furnace 1, combustion air can be fed effectively, and the unburned components and CO staying in the vicinity of the inner wall of the furnace 1 are burned to combustion exhaust gas 6, so that the unburned components and CO staying in the vicinity of the inner wall of the furnace 1 can be reduced.

And, the combustion exhaust gas 6 generated by burning the unburned components and CO in the furnace 1 flows down toward the downstream side of the furnace 1 and is discharged outside the system from the furnace 1.

Figure 2:
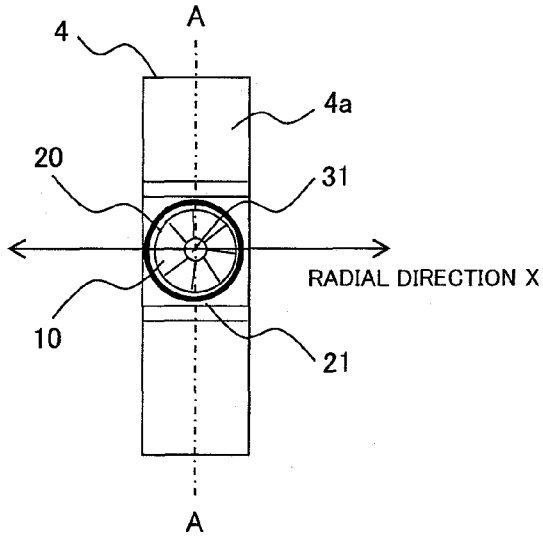
FIG. 2 is a front view showing the lower after-air nozzle installed in the furnace of the pulverized coal boiler that is an embodiment of the present invention shown in FIG. 1.
Figure 3:
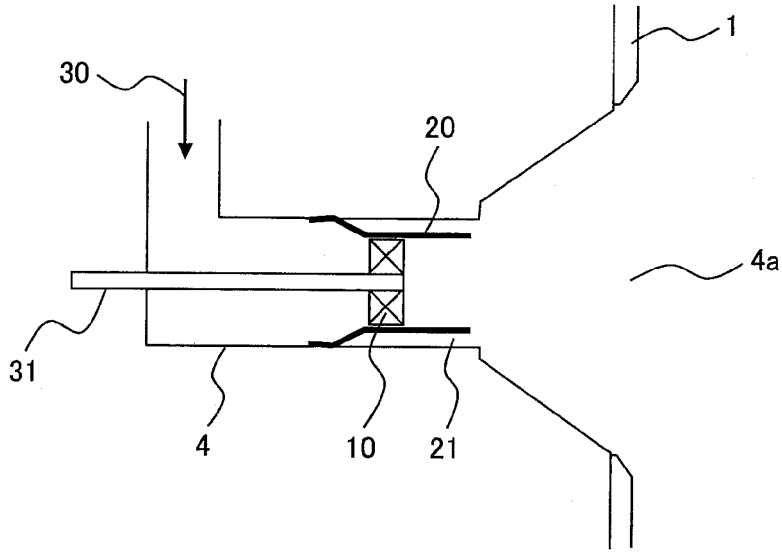
FIG. 3 is a cross sectional view of the line A-A of the lower after-air nozzle of the embodiment shown in FIG. 2.

FIG. 2 shows a front view of the lower after-air nozzle 4 viewed from the inside of the furnace 1 among the upper and lower after-air nozzles 3 and 4 which are installed on the wall surface of the furnace 1 of the pulverized coal boiler which is an embodiment of the present invention shown in FIG. 1 and FIG. 3 shows a cross sectional view of the line A-A of the lower after-air nozzle 4 shown in FIG. 2.

As shown in FIGS. 2 and 3, among the after-air nozzles formed at the upper and lower stages which are installed on the wall surface of the furnace 1 of the pulverized coal boiler which is an embodiment of the present invention, with respect to the lower after-air nozzles 4 positioned at the lower stage, an opening 4*a* which is an outlet of the after-air nozzle 4 interconnected to the inside of the furnace 1 is formed in a rectangular shape.

In the lower after-air nozzle 4, so that the flow path area of the combustion air 30 flowing inside the after-air nozzle 4 is minimized, at the central position in the longitudinal direction in the flow path of the lower after-air nozzle 4, a cylindrical section 20 extending in the flow path direction of the combustion air 30 flowing inside the after-air nozzle 4 for defining the minimum flow path area of the combustion air 30 is installed concentrically inside the after-air nozzle 4 and inside the cylindrical section 20, a circular swirl blade 10 for giving a swirl force to the combustion air 30 flowing in the flow path of the minimum flow path area defined by the cylindrical section 20 is installed.

Furthermore, the flow path of the lower after-air nozzle 4, as shown in FIG. 3, is formed so that the flow path area is expanded from the position of the minimum flow path area defined by the cylindrical section 20 installed at the central portion in the longitudinal direction of the flow path toward the opening 4*a* interconnected to the inside of the furnace 1 and the opening 4*a* of the lower after-air nozzle 4 which is a flow path outlet interconnected to the inside of the furnace 1 is formed in a rectangular shape. In FIGS. 2 and 3, there is a gap 21 between the cylindrical section 20 and the after-air nozzle 4, though a structure that the outside diameter of the cylindrical section 20 is permitted to adhere closely to the inside of the rectangular flow path of the after-air nozzle 4 to eliminate the gap 21 provides no trouble.

Further, the circular swirl blade 10 installed inside the cylindrical section 20 for giving a swirl force to the combustion air 30 is connected to a drive unit 70 with a connection shaft 31 and by the drive of the drive unit 70 and via the connection shaft 31, the circular swirl blade 10 is structured so as to move back and forth inside the cylindrical section 20 in the flow direction of the combustion air 30.

Figure 8:
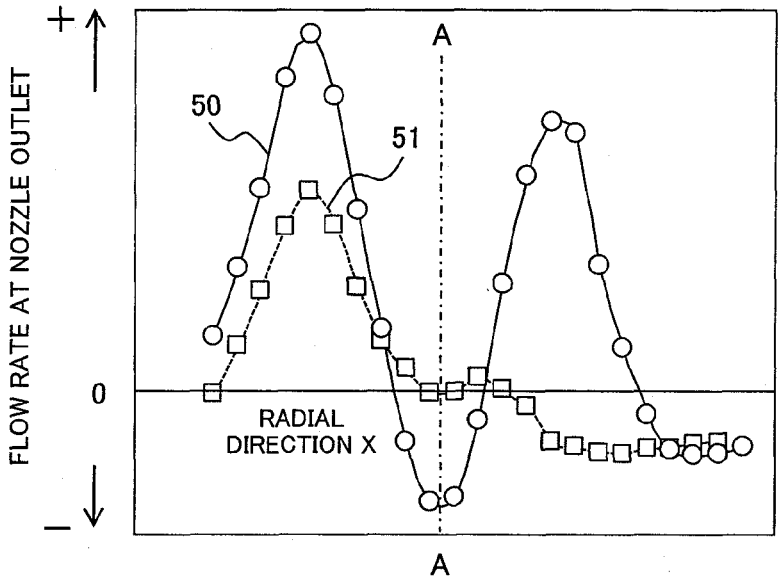
FIG. 8 is a drawing showing the measured values of the flow rate distribution in the radial direction X at the outlet of the lower after-air nozzle of this embodiment.

Among the after-air nozzles having an upper and lower stage structure installed on the wall surface of the furnace 1 of the pulverized coal boiler which are the embodiments shown in FIGS. 2 and 3, with respect to the lower after-air nozzle 4, the measured values of the flow rate distribution at the position directly beneath the flow of the opening 4*a* of the after-air nozzle 4 in the radial direction X (corresponding to the radial direction X shown in FIG. 2) on the horizontal surface are shown in FIG. 8 together with a conventional embodiment.

In the measured values of the flow rate distribution of the injection flow 8 injecting from the lower after-air nozzle 4 of this embodiment shown in FIG. 8 the opening 4*a* of which is in a rectangular shape, the flow rate distribution at the outlet of the lower after-air nozzle 4 of this embodiment is indicated with a solid line 50 and as a conventional embodiment, the flow rate distribution of an after-air nozzle structure without the cylindrical section 20 is indicated with a dashed line 51.

As understandable from the measured values of the flow rate distribution 50 in the radial direction X of the injection flow 8 at the outlet of the lower after-air nozzle 4 of this embodiment shown in FIG. 8, in the flow rate distribution 50 of the injection flow 8, for an axis of symmetry of the axial line A-A of the lower after-air nozzle 4, on both sides of the axial line, a maximum value of the flow rate is formed and it is found that the injection flow 8 of combustion air injecting into the furnace 1 from the outlet of the lower after-air nozzle 4 blows out uniformly on both sides. Further, in the central portion, there is a minus flow rate component and a back flow for drawing surrounding gas due to a negative pressure is seen. This indicates that the injection flow injected from the lower after-air nozzle 4 forms a strong swirl flow.

As mentioned above, the lower after-air nozzle 4 of this embodiment, since the swirl blade 10 for giving a swirl force to the combustion air 30 flowing down inside the cylindrical section 20 installed in the central position in the longitudinal direction in the flow path of the lower after-air nozzle 4 is installed, the swirl flow caused by the swirl blade 10 is protected inside the cylindrical section 20, so that a swirl flow free of a deflection flow can be formed.

As a result, even when the opening 4*a* of the outlet of the lower after-air nozzle 4 interconnected to the inside of the furnace 1 is formed in a rectangular shape as shown in FIG. 2, the injection flow 8 of the combustion air 30 injecting from the opening 4*a* of the outlet of the lower after-air nozzle 4, along the inner wall of the furnace 1, for an axis of symmetry of the axial line A-A of the after-air nozzle 4, is formed so as to expand uniformly on both sides on the horizontal surface, so that an effect can be obtained that to the unburned components and CO existing in the vicinity of the inner wall of the furnace 1, the injection flow 8 can be fed to burn and the unburned components and CO existing in the vicinity of the inner wall of the furnace 1 can surely be reduced.

On the other hand, in the flow rate distribution 1 of the conventional embodiment indicated by the dashed line, the maximum value of the flow rate is seen only on the left side and it is found that the injection flow is deflected and injected from the after-air nozzle. In such a case, for the region of the unburned components and CO existing in the vicinity of the inner wall of the furnace 1, the region of feeding the injection flow 8 from the after-air nozzle is narrow, so that an unreacted region is expanded and the reduction effect of the unburned components and CO in the vicinity of the inner wall of the furnace 1 is lowered.

On the other hand, to the injection flow 8 injected into the furnace 1 from the outlet of the lower after-air nozzle 4 installed in the pulverized coal boiler of this embodiment, as mentioned above, by the swirl blade 10 installed inside the cylindrical section 20 installed in the central position in the longitudinal direction in the flow path of the lower after-air nozzle 4, to the combustion air 30 flowing down in the flow path of the lower after-air nozzle 4, a swirl force is given.

Therefore, to effectively feed the injection flow 8 injected into the furnace 1 from the outlet of the lower after-air nozzle 4 to the unburned components and CO existing in the vicinity of the inner wall of the furnace 1, it is desirable to increase the swirl force of a swirl flow generated by the swirl blade 10 installed inside the cylindrical section 20 of the lower after-air nozzle 4.

To increase the swirl force of the swirl flow by the swirl blade 10, it is desirable to increase a blade angle θ which is an arrangement angle of the swirl blade with the flow of combustion air regarding the swirl blade composing the swirl blade 10. However, if the blade angle θ is increased, the resistance of the flow of combustion air is increased and the pressure loss is increased. If the pressure loss is increased, a necessary quantity of combustion air cannot be fed into the furnace 1 from the lower after-air nozzle 4, so that for the pressure loss allowable in the lower after-air nozzle 4, an upper limit value "a" is set.

Figure 9:
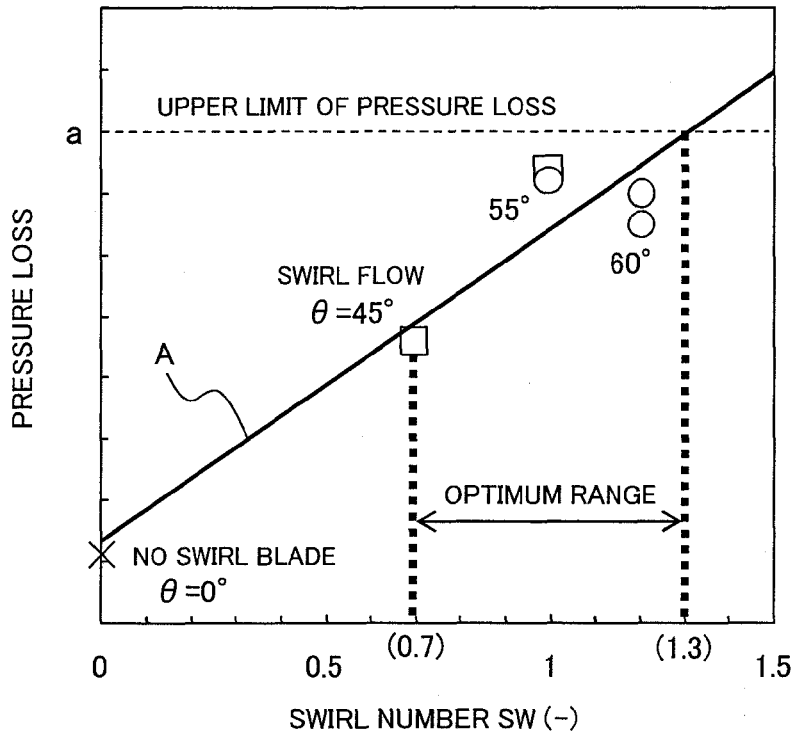
FIG. 9 is a characteristic diagram showing the relationship between the swirl number and the pressure loss in the lower after-air nozzle of this embodiment.

FIG. 9, in the lower after-air nozzle 4 of this embodiment, is a characteristic diagram showing the relationship between the swirl number SW and the pressure loss of the swirl blade 10 installed inside the cylindrical section 20. Further, FIG. 10 is a schematic view of the swirl blade when obtaining the swirl number SW in the swirl blade 10 of this embodiment.

Figure 10:
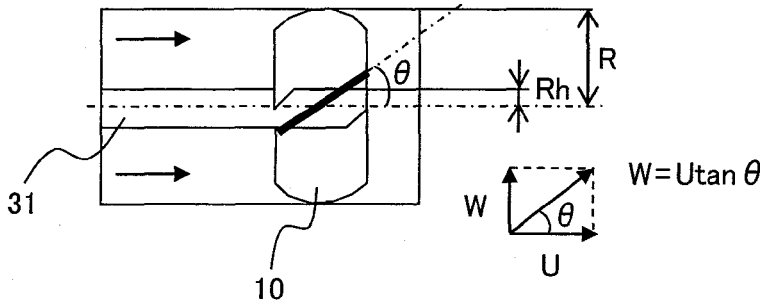
FIG. 10 is a schematic view of the swirler when obtaining the swirl number SW in the swirl blade of this embodiment.

In FIGS. 9 and 10, the swirl number SW of the swirl blade 10 installed in the lower after-air nozzle 4 of this embodiment is obtained by calculation from Formulas (1) to (3). Further, Table 1 shows the values of the swirl number SW obtained by calculation.

[Formula 1]

$$\text{Swirl number } SW = \frac{G\phi}{GxR} = \frac{2}{3}\left[\frac{1-\left(\frac{Rh}{R}\right)^3}{1-\left(\frac{Rh}{R}\right)^2}\right]\tan\theta \tag{1}$$

In Formula (1), SW: swirl number, Gϕ: angular momentum, Gx: axial momentum, Rh: axial radius, R: flow path radius, and θ: blade angle.

[Formula 2]

$$\text{Angular momentum } G\phi = \int_{Rh}^{R} 2\pi\rho UWr^2 dr \tag{2}$$

In Formula (2), Gϕ: angular momentum, ρ: fluid density, U: axial flow rate, W: radial flow rate, Rh: axial radius, and R: flow path radius.

[Formula 3]

$$\text{Axial momentum } Gx = = \int_{Rh}^{R} 2\pi\rho U^2 r dr \quad (3)$$

In Formula (3), Gx: axial momentum, ρ: fluid density, U: axial flow rate, Rh: axial radius, and R: flow path radius.

TABLE 1

| Rh/R — | θ deg | SW — |
|---|---|---|
| 0.22 | 0 | 0 |
| 0.22 | 45 | 0.7 |
| 0.22 | 55 | 1.0 |
| 0.22 | 60 | 1.2 |
| 0.22 | 62 | 1.3 |

In the characteristic diagram, shown in FIG. 9, showing the relationship between the swirl number SW and the pressure loss of the swirl blade 10 installed in the lower after-air nozzle 4 of this embodiment, as a conventional embodiment, the data of pressure loss not including the swirl blade 10 is indicated assuming that the blade angle θ without a swirl blade is equal to 0.

And, as data of the pressure loss of the swirl blade 10 installed in the lower after-air nozzle 4 of this embodiment, when the blade angle θ of the swirl blade 10 is 45°, 55°, and 60°, the swirl number SW and pressure loss are measured and plotted respectively. Further, the upper limit value "a" of the pressure loss is also shown.

In FIG. 9, the characteristic line segment showing the relationship between the swirl number SW and the pressure loss by the swirl blade 10 installed in the after-air nozzle 4 is indicated by a solid line as an approximate line A of the pressure loss and swirl number.

It can be understood from FIG. 9 that to form a strong swirl flow along the inner wall of the furnace 1 in an injection flow 9 injected from the lower after-air nozzle 4, as the swirl blade 10 of the lower after-air nozzle 4, the blade angle must be 45° or higher and the swirl number at this time is 0.7. Namely, to obtain a strong swirl flow by the swirl blade 10, the blade angle must be 45° or higher.

Further, from the viewpoint of the upper limit value "a" of the pressure loss, the swirl number SW 1.3 when the dashed line of the upper limit value "a" of the pressure loss and the solid line A cross each other is an upper limit value of the swirl number SW and the blade angle θ of the swirl blade 10 in the case of the swirl number SW 1.3, as shown in Table 1, is 62°.

From the aforementioned, it is found that if the swirl number SW of the swirl blade 10 installed inside the cylindrical section 20 of the lower after-air nozzle 4 of the embodiment of the present invention is set within the range from 0.7 to 1.3 when the blade angle θ is within the range from 45° to 62°, the range is an optimum range.

As clearly shown by the above explanation, in this embodiment, the swirl number SW of the swirl blade 10 of the lower after-air nozzle 4, when the blade angle θ of the swirl blade is within the range from 45° to 62°, is set within the range from 0.7 to 1.3 and the cylindrical section 20 is installed, thus a swirl flow free of a deflection flow can be formed.

As a result, the injection flow 8 of the combustion air 30 injecting from the opening of the lower after-air nozzle 4 interconnected to the inside of the furnace 1, along the inner wall of the furnace 1, for an axis of symmetry of the axial line A-A of the after-air nozzle 4, is expanded uniformly on both sides on the horizontal surface, so that an effect can be obtained that to the unburned components and CO existing in the vicinity of the inner wall of the furnace 1, the injection flow 8 can be fed to burn and the unburned components and CO existing in the vicinity of the inner wall of the furnace 1 can surely be reduced. Furthermore, the generation of NOx can be suppressed.

According to this embodiment, when the opening of the outlet of the after-air nozzle is formed in a rectangular shape, a pulverized coal boiler capable of feeding the injection flow of combustion air injecting into the furnace from the after-air nozzle to the vicinity of the inner wall of the furnace and reducing the unburned components and CO existing in the vicinity of the inner wall of the furnace can be realized.

Embodiment 2

Next, another embodiment of the lower after-air nozzles installed in the furnace of the pulverized coal boiler of the present invention will be explained.

Figure 4:
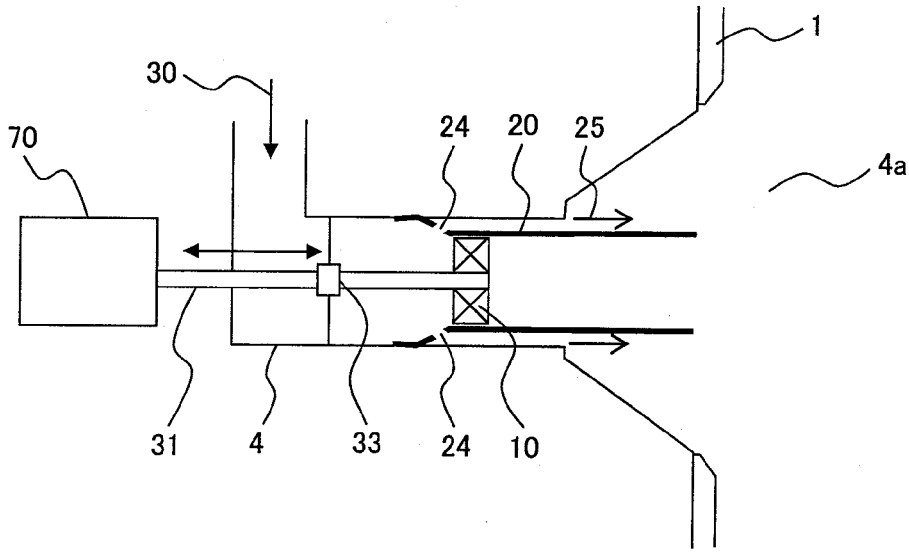
FIG. 4 is a cross sectional view showing the lower after-air nozzle installed in the furnace of the pulverized coal boiler that is another embodiment of the present invention.
Figure 5:
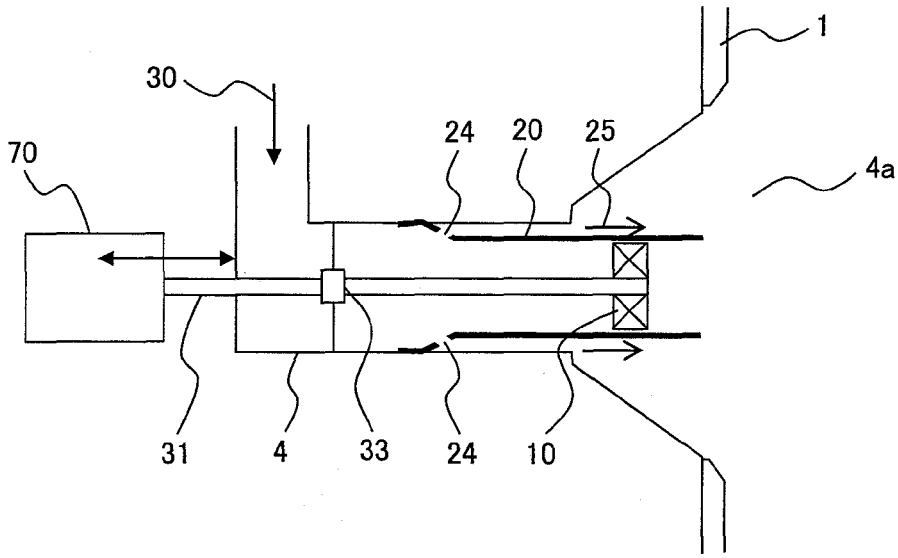
FIG. 5 is a cross sectional view of the lower after-air nozzle showing the state that the swirl blade of the lower after-air nozzle of the embodiment shown in FIG. 4 is moved to the furnace side.

FIGS. 4 and 5 show a cross sectional view of the lower after-air nozzle of another embodiment installed in the furnace of the pulverized coal boiler of the present invention.

The lower after-air nozzle 4 installed in the furnace of the pulverized coal boiler of this embodiment shown in FIGS. 4 and 5 is common to the lower after-air nozzle of the preceding embodiment shown in FIGS. 2 and 3 in the basic constitution, so that the explanation of the constitution common to the two is omitted and only the different constitution will be explained below.

The lower after-air nozzle of this embodiment shown in FIGS. 4 and 5 is formed so that the length of the cylindrical section 20 is extended from the middle portion of the flow path of the after-air nozzle 4 in the longitudinal direction up to the opening 4*a* of the lower after-air nozzle which is the flow path outlet interconnected to the inside of the furnace 1. Further, the swirl blade 10 installed inside the cylindrical section 20 is connected to the drive unit 70 via the connection shaft 31, and by the drive operation of the drive unit 70, the swirl blade 10 can move in the longitudinal direction of the flow path inside the cylindrical section 20 via the connection shaft 31, and the swirl blade 10 is structured, as shown in FIG. 5, so as to move to the leading edge side of the cylindrical section 20 facing the side of the furnace 1.

Further, the connection shaft 31 is supported rotatably by a support section 33 installed on the inner wall of the lower after-air nozzle 4.

According to the lower after-air nozzle 4 having the aforementioned constitution of this embodiment, the length of the cylindrical section 20 is extended up to the opening 4*a* of the flow path of the after-air nozzle 4, thus the swirl flow of the combustion air 30 formed by the swirl blade 10 inside the cylindrical section 20 is protected, so that the injection flow 8 injected into the furnace 1 from the opening 4*a* of the after-air nozzle 4 can form a stronger swirl flow expanded uniformly on both sides along the wall surface of the furnace 1 than the embodiment shown in FIGS. 2 and 3.

Further, as shown in FIG. 5, by the drive operation of the drive unit 70, via the connection shaft 31 rotatably supported by the support section 33, the swirl blade 10 can move in the longitudinal direction of the flow path inside the cylindrical section 20, and the swirl blade 10 moves to the leading edge side of the cylindrical section 20 facing the side of the furnace 1 shown in FIG. 5, thus the approach section of the swirl flow is shortened, so that the swirl strength becomes weak, and the injection flow 8 injecting from the opening 4*a* of the lower after-air nozzle 4, within the range from the injection flow along the inner wall of the furnace 1 to the injection flow flowing inside the furnace 1, can be regulated in accordance with the combustion state of the boiler. Therefore, there is an advantage that the swirl strength of the injection flow 8 injecting from the lower after-air nozzle 4 into the furnace 1 can be regulated.

Further, in the lower after-air nozzle 4 of this embodiment, the length of the cylindrical section 20 is extended up to the opening 4*a* of the lower after-air nozzle 4, thus there are possibilities that combustion ash may be deposited on the outer peripheral wall of the cylindrical section 20. Therefore, at least one leak hole 24 is formed in the cylindrical section 20, thus a highly reliable lower after-air nozzle 4 for permitting a part of the combustion air 30 to flow down as leak air 25 along the outer peripheral wall of the cylindrical section 20 from the leak hole 24 and suppress the deposition of combustion ash on the outer peripheral wall of the cylindrical section 20 can be provided.

Figure 6:
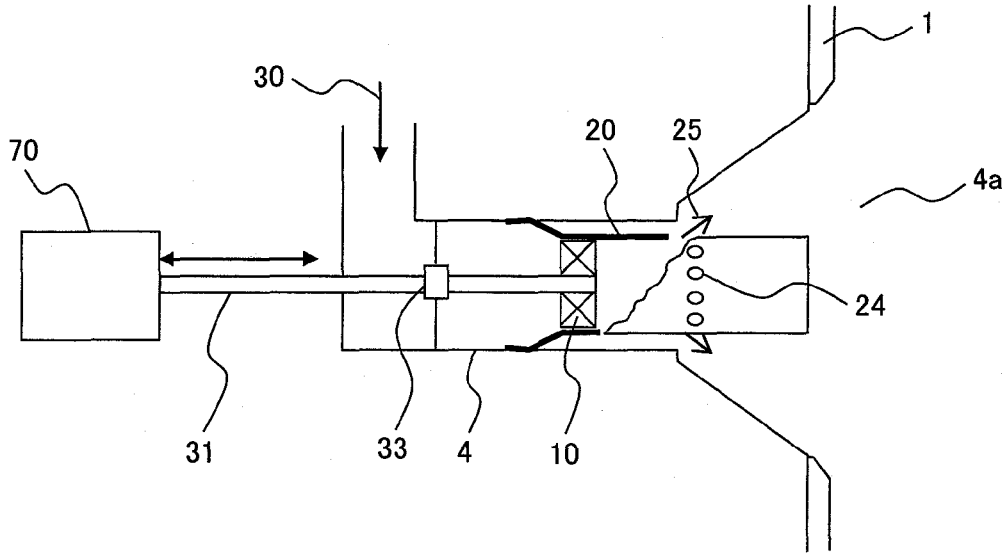
FIG. 6 is a modification of the structure of the cylindrical section of the embodiment shown in FIG. 4.

Further, combustion ash is deposited mainly on the leading edge of the cylindrical section 20, and as shown in FIG. 6, the leak holes 24 are formed at the upstream position of the leading edge of the cylindrical section 20, and the leak air 25 flows down along the outer peripheral wall of the cylindrical section, thus the similar effect can be obtained.

According to this embodiment, when the opening of the outlet of the after-air nozzle is formed in a rectangular shape, a pulverized coal boiler capable of feeding the injection flow of combustion air injecting into the furnace from the after-air nozzle to the vicinity of the inner wall of the furnace and reducing the unburned components and CO existing in the vicinity of the inner wall of the furnace can be realized.

Embodiment 3

Next, still another embodiment of the lower after-air nozzles installed in the furnace of the pulverized coal boiler of the present invention will be explained.

Figure 7:
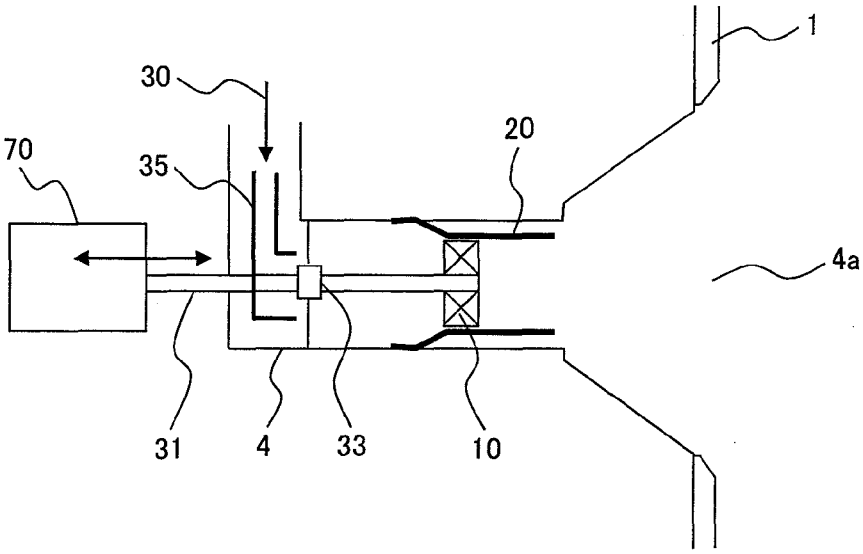
FIG. 7 is a cross sectional view of the lower after-air nozzle installed in the furnace of the pulverized coal boiler which is still another embodiment of the present invention.

FIG. 7 shows a cross sectional view of the lower after-air nozzle of still another embodiment installed in the furnace of the pulverized coal boiler of the present invention.

The lower after-air nozzle 4 installed in the furnace of the pulverized coal boiler of this embodiment shown in FIG. 7 is common to the lower after-air nozzle of the embodiment shown in FIG. 6 in the basic constitution, so that the explanation of the constitution common to the two is omitted and only the different constitution will be explained below.

The lower after-air nozzle 4 of this embodiment shown in FIG. 7 is structured so as to include a rectifying plate 35 for rectifying the flow of the combustion air 30 on the upstream side of the swirl blade 10.

According to the lower after-air nozzle 4 of this embodiment, since the rectifying plate 35 is arranged, the flow of the combustion air 30 on the upstream side of the swirl blade 10 is rectified and flows into the swirl blade 10, so that there is an advantage that the swirl flow by the swirl blade 10 is suppressed from generation of a deflection flow of air and a more uniform swirl flow free of a deflection flow can be formed.

Further, since the flow of the combustion air 30 is rectified by the rectifying plate 35, an effect of reducing the pressure loss of the combustion air 30 flowing down in the flow path of the lower after-air nozzle 4 can be expected. Further, the rectifying plate 35 of this embodiment can be applied to the structure of the lower after-air nozzles 4 shown in FIGS. 2 to 6 and the similar effect can be obtained.

Also by this embodiment, a pulverized coal boiler for permitting an injection flow of combustion air injecting from the after-air nozzles into the furnace to be fed in the vicinity of the inner wall of the furnace and making it possible to reduce unburned components and CO which exist in the vicinity of the inner wall of the furnace can be realized.

Figure 11:
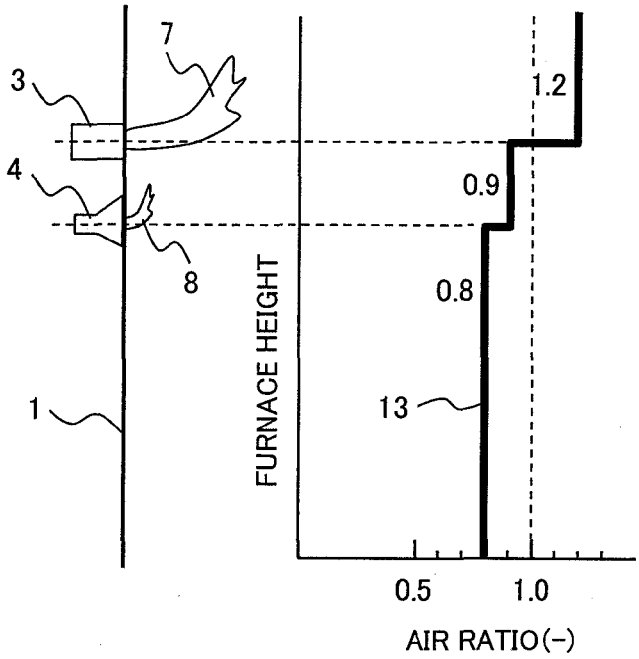
FIG. 11 is an intra-furnace air ratio distribution diagram showing the intra-furnace air ratio distribution state in the furnace of the pulverized coal boiler of this embodiment.

FIG. 11, in the pulverized coal boiler including the lower after-air nozzles 4 and the upper after-air nozzles 3 composing the upper and lower after-air nozzles of this embodiment, shows an embodiment of the intra-furnace air ratio distribution of the furnace 1.

In FIG. 11, respectively by taking partial charge, the upper after-air nozzle 3 feeds an injection flow 7 to the furnace center of the furnace 1 and the lower after-air nozzle 4 feeds the injection flow 8 to the vicinity of the inner wall of the furnace 1, thus after-air of combustion air can be fed more quickly and uniformly into the furnace 1, and the unburned components and CO can be reduced, and furthermore, the generation of NOx can be suppressed.

For example, as the intra-furnace air ratio distribution state is shown in FIG. 11 as an intra-furnace air ratio distribution line 13, the burner air ratio in the upstream portion of the lower after-air nozzle 4 is set to 0.8 (20% smaller than the theoretical air volume necessary for perfect combustion of pulverized coal fuel), and so that the air ratio after the injection flow 8 injecting as combustion air from the lower after-air nozzle 4 is injected becomes 0.9, air of an air ratio of 0.1 is fed from the lower after-air nozzle 4.

And, until immediately before the upper after-air nozzle 3, due to an air ratio of less than 1.0 and insufficient oxygen, the reduction region is expanded, and the reduction time is ensured, and NOx is reduced, thus the generation of NOx is suppressed. The upper after-air nozzle 3 feeds residual combustion air by the injection flow 7 and the burner air ratio in the upstream portion of the upper after-air nozzle 3 is operated, for example, so as to be an air ratio of 1.2.

If the air ratio of the injection flow 7 injecting from the lower after-air nozzle 4 after after-air is injected is less than 1.0, regardless of the numerical value of the intra-furnace air ratio distribution line 13, the similar effect can be obtained.

Therefore, according to this embodiment, the unburned components and CO can be reduced. Further, there is an advantage that the lower after-air nozzle 4 feeds a small amount of combustion air to cause slow combustion, thus the generation of thermal NOx can be suppressed.

Figure 12:
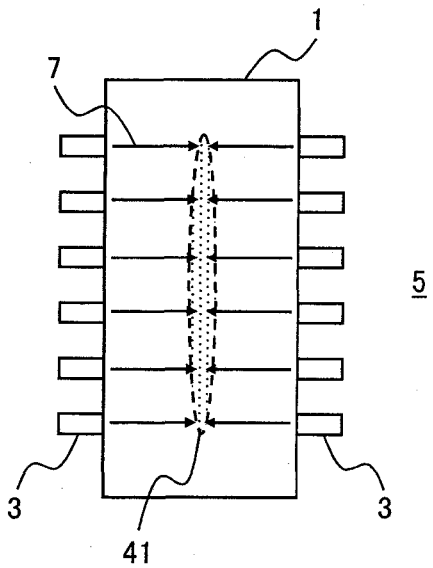
FIG. 12 is an image diagram of the injection flow injecting into the furnace from the upper after-air nozzles in this embodiment shown in FIG. 11.
Figure 13:
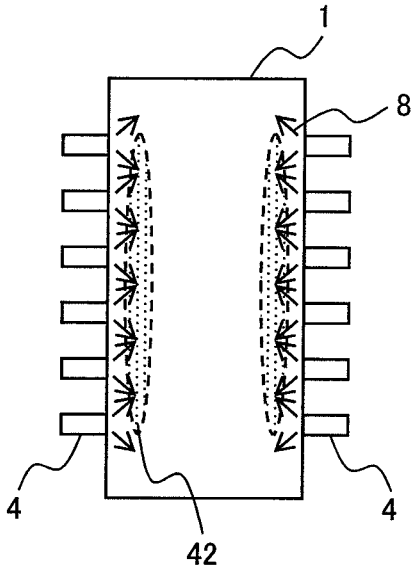
FIG. 13 is an image diagram of the injection flow injecting in the furnace from the lower after-air nozzles in this embodiment shown in FIG. 11.

Next, in FIGS. 12 and 13, the images of the injection flows 7 and 8 on the cross sections of the furnace in the positions of the upper and lower after-air nozzles 3 and 4 shown in FIG. 11 are shown.

As shown in FIG. 12, the upper after-air nozzles 3 feed combustion air as the injection flow 7 to CO of high concentration and an unburned component region 41 that exists at the furnace center of the furnace 1.

Further, as shown in FIG. 13, the lower after-air nozzles 4 feed combustion air as the injection flow 8 to CO of high concentration and an unburned component region 42 that exists in the vicinity of the inner wall of the furnace 1. As mentioned above, the combustion air fed to the inner space of the furnace 1 is fed into the furnace 1 by the injection flow 7 from the upper after-air nozzles 3 and the injection flow 8 from the lower after-air nozzles 4 respectively by taking partial charge, thus the combustion air can be mixed quickly and uniformly in the furnace.

According to this embodiment, when the opening of the outlet of each after-air nozzle is formed in a rectangular shape, a pulverized coal boiler capable of feeding the injection flow of combustion air injecting into the furnace from the after-air nozzle to the vicinity of the inner wall of the furnace and reducing the unburned components and CO existing in the vicinity of the inner wall of the furnace can be realized.

INDUSTRIAL APPLICABILITY

The present invention can be applied to a pulverized coal boiler including after-air nozzles suitable for combustion of pulverized coal.

LEGEND

1: Furnace, 2: Burner, 3: Upper after-air nozzle, 4*a*: Opening, 4: Lower after-air nozzle, 5: Combustion gas of burner section, 6: Combustion exhaust gas, 7, 8: Injection flow, 10: Swirl blade, 13: Air ratio distribution, 20: Cylindrical section, 21: Gap, 24: Leak hole, 25: Leak air, 30: Combustion air, 31: Connection shaft, 33: Support section, 35: Rectifying plate, 41, 42: High-concentration CO region, 50: Flow rate distribution of embodiment, 51: Flow rate distribution of conventional embodiment, 70: Drive unit, A: Approximate line of pressure loss and swirl number.

The invention claimed is:

1. A pulverized coal boiler comprising burners installed on a furnace wall for feeding pulverized coal into the furnace together with combustion air and burning the pulverized coal at lower than a theoretical air ratio and lower and upper after-air nozzles installed respectively on the furnace wall on a downstream side of the burners for feeding combustion air of a deficiency of the burners into the furnace which are arranged at two stages on the downstream side and an upstream side, wherein:

among the lower and upper after-air nozzles interconnected to an inside of the furnace, a downstream side of at least one lower after-air nozzle of the lower after-air nozzles positioned on the upstream side is formed in a rectangular flow path with a rectangular shape, a cylindrical section for defining a minimum flow path area of combustion air flowing through a flow path of the at least one lower after-air nozzle is installed inside of the rectangular flow path coaxially with the rectangular flow path, a leak hole through which a part of the combustion air flowing inside the cylindrical section flows to an outer wall side of the cylindrical section is formed on a wall surface of the cylindrical section, a swirl blade for giving a swirl force to the combustion air flowing through the flow path of the at least one lower after-air nozzle is installed inside of the cylindrical section, and the flow path of the at least one lower after-air nozzle is formed so that a flow path area of the flow path of the at least one lower after-air nozzle through which the combustion air flows from a position where the cylindrical section is installed toward an opening of the at least one lower after-air nozzle is expanded.

2. The pulverized coal boiler according to claim 1, wherein:

the swirl blade is formed in a circular shape in an external form in correspondence to an inner wall of the cylindrical section.

3. The pulverized coal boiler according to claim 1 or 2, wherein:

a leading edge of the cylindrical section on a furnace side is extended up to the vicinity of the opening of the at least one lower after-air nozzle and a drive unit is installed so that the swirl blade can move in the longitudinal direction inside the cylindrical section in a flow path direction of the at least one lower after-air nozzle, and a connection shaft for connecting the drive unit to the swirl blade is installed.

4. The pulverized coal boiler according to claim 1, wherein:

a rectifying plate for guiding the combustion air to the upstream side of the swirl blade installed on the at least one lower after-air nozzle is installed.

5. The pulverized coal boiler according to claim 1, wherein:

in a swirl flow of the combustion air injecting from the swirl blade, a swirl number SW indicating a swirl strength of the swirl flow, when a blade angle of the swirl blade is within a range from 45° to 62°, is set to $0.7 \leq SW \leq 1.3$.

6. The pulverized coal boiler according to claim 1, wherein:

a flow rate of the combustion air fed to the lower after-air nozzles is set so as to be a flow rate lower than a flow rate of the combustion air fed to the upper after-air nozzles.

7. A pulverized coal boiler comprising:

a furnace comprising a furnace wall;

a plurality of burners disposed on the furnace wall, the burners for feeding pulverized coal and combustion air into the furnace, the burners for feeding the combustion air of a volume lower than theoretical air necessary for perfect combustion of the pulverized coal;

a plurality of lower and upper after-air nozzles disposed on the furnace wall downstream of the burners, the upper after-air nozzles being disposed downstream of the lower after-air nozzles, the lower and upper after-air nozzles for feeding combustion air into the furnace, an outlet of at least one lower after-air nozzle of the lower after-air nozzles comprising a rectangular flow path, the at least one lower after-air nozzle comprising a cylindrical section defining a minimum flow path area of the combustion air, the cylindrical section communicating the rectangular flow path, the cylindrical section being disposed coaxially with the rectangular flow path, at least one leak hole being formed through a wall of the cylindrical section, and the at least one leak hole allowing a part of the combustion air flowing inside the cylindrical section to flow to an outer wall side of the cylindrical section; and a swirl blade installed inside the cylindrical section for giving a swirl force to the combustion air, wherein an area of flow expands from a position of the minimum flow path area to a position at the outlet.

8. The pulverized coal boiler according to claim 7, wherein the swirl blade is formed in a circular shape in an external form in correspondence to an inner wall of the cylindrical section.

9. The pulverized coal boiler according to claim 7, wherein a leading edge of the cylindrical section extends up to a vicinity of the outlet, a drive unit is configured to move the swirl blade in a longitudinal direction inside the cylindrical section, and a connection shaft connects the drive unit to the swirl blade.

10. The pulverized coal boiler according to claim 7, wherein a rectifying plate is installed in the at least one lower after-air nozzle, and the rectifying plate rectifies a flow of the combustion air on an upstream side of the swirl blade.

11. The pulverized coal boiler according to claim 7, wherein a swirl flow of the combustion air is created by the swirl blade, and a swirl number SW indicating a swirl strength of the swirl flow, when a blade angle of the swirl blade is within a range from 45° to 62°, is set to $0.7 \leq SW \leq 1.3$.

12. The pulverized coal boiler according to claim 7, wherein a flow rate of the combustion air fed to the lower after-air nozzles is lower than a flow rate of the combustion air fed to the upper after-air nozzles.

* * * * *